US008635941B2

(12) United States Patent
Du

(10) Patent No.: US 8,635,941 B2
(45) Date of Patent: Jan. 28, 2014

(54) METHOD AND APPARATUS FOR CONTROLLING A PUMP

(75) Inventor: Hongliu Du, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 818 days.

(21) Appl. No.: 12/874,248

(22) Filed: Sep. 2, 2010

(65) Prior Publication Data

US 2011/0094213 A1 Apr. 28, 2011

Related U.S. Application Data

(60) Provisional application No. 61/254,773, filed on Oct. 26, 2009.

(51) Int. Cl.
*E02F 9/22* (2006.01)

(52) U.S. Cl.
USPC ..... 92/12.1

(58) Field of Classification Search
USPC ..... 91/473, 464; 92/12.1, 12.2, 163
See application file for complete search history.

(56) References Cited

U.S. PATENT DOCUMENTS

| | | | | |
|---|---|---|---|---|
| 5,226,349 | A * | 7/1993 | Alme et al. | 92/12.2 |
| 6,010,309 | A | 1/2000 | Takamura et al. | |
| 6,158,969 | A * | 12/2000 | Graf et al. | 60/445 |
| 6,435,999 | B1 | 8/2002 | Nanri et al. | |
| 6,623,247 | B2 | 9/2003 | Du | |
| 6,725,658 | B1 | 4/2004 | Lemmen et al. | |
| 6,852,064 | B2 | 2/2005 | Carlson et al. | |
| 7,243,492 | B2 | 7/2007 | Niidome et al. | |
| 7,469,534 | B2 * | 12/2008 | Nishi et al. | 60/445 |
| 7,503,173 | B2 * | 3/2009 | Dong et al. | 92/12.2 |
| 7,854,182 | B2 * | 12/2010 | Nakatani et al. | 60/494 |
| 7,975,599 | B2 * | 7/2011 | Geissler et al. | 92/12.2 |
| 8,074,558 | B2 * | 12/2011 | Knussman et al. | 92/12.2 |
| 2004/0003590 | A1 | 1/2004 | Kado et al. | |
| 2005/0085979 | A1 | 4/2005 | Carlson et al. | |
| 2006/0032220 | A1 | 2/2006 | Swartzer et al. | |
| 2008/0279700 | A1 | 11/2008 | Anderson et al. | |

FOREIGN PATENT DOCUMENTS

| | | |
|---|---|---|
| DE | 102007006868 | 8/2008 |
| JP | 2005145670 | 6/2005 |
| JP | 2006183413 | 7/2006 |
| JP | 2007205464 | 8/2007 |
| KR | 100198158 | 6/1999 |
| KR | 100221588 | 9/1999 |
| KR | 100752115 | 8/2007 |
| WO | 0127472 | 4/2001 |

* cited by examiner

*Primary Examiner* — Thomas E Lazo

(57) ABSTRACT

An electro-hydraulic control system for pump control is disclosed. The hydraulic actuator is configured to control the inclination of a swashplate. The position of the hydraulic actuator is controlled by controlling the flow of pressurized fluid into and out of two pressure chambers, one on either side of the actuator. A fluid passageway is provided that selectively connects the passageway to tank. The passageway has an orifice for each pressure chamber, and the actuator is configured to selectively block all or a portion of one or more of the orifices, depending on the position of the actuator. The components of the control system are configured such that the actuator will return to a neutral or near-neutral position upon loss of electric power.

20 Claims, 5 Drawing Sheets

METHOD AND APPARATUS FOR CONTROLLING A PUMP

RELATED APPLICATIONS

This application is based upon and claims the benefit of priority from U.S. Provisional Application No. 61/254,773 by Hongliu Du, filed Oct. 26, 2009, the contents of which are expressly incorporated herein by reference.

TECHNICAL FIELD

The present disclosure relates generally to a hydraulic actuator, and more particularly, to a fail neutral electro-hydraulic control system for controlling a variable displacement pump.

BACKGROUND

Variable displacement hydraulic pumps are widely used in hydraulic systems to provide pressurized hydraulic fluid for various applications. Many types of machines such as dozers, loaders, and the like, rely heavily on hydraulic systems to operate, and utilize variable displacement pumps to provide a greater degree of control over fixed displacement pumps.

Various control schemes have been utilized to control the swashplate angle of such variable displacement hydraulic pumps. One such control scheme is disclosed in U.S. Pat. No. 6,553,891, filed Jul. 9, 2001, to Carsten Fiebing, which is hereby incorporated by reference. However, it may be beneficial to provide a control scheme that fails to a neutral position upon loss of power.

SUMMARY OF THE INVENTION

A hydraulic system is disclosed having a source of pressurized fluid, a tank, an actuator disposed between a first pressure chamber and a second pressure chamber, a fluid passageway having a first orifice in selective communication with the first pressure chamber and a second orifice in selective communication with the second pressure chamber, and a drain valve disposed in the fluid passageway having an open position and a closed position. According to this disclosure fluid is passable from both the first orifice and the second orifice to the tank when the drain valve is in the open position, and fluid is restricted from passing from both the first orifice and the second orifice to the tank when the drain valve is in the closed position.

A method for controlling an inclination of a swashplate is further disclosed. This method includes the steps of changing the inclination of a swashplate by energizing a first electrical device associated with a first control valve, de-energizing a second electrical device associated with a second control valve, and energizing a third electrical device associated with a drain valve; and returning the swashplate to a neutral position or a near-neutral position by de-energizing the first electrical device, de-energizing the second electrical device, and de-energizing the third electrical device.

DETAILED DESCRIPTION

Figure 1:
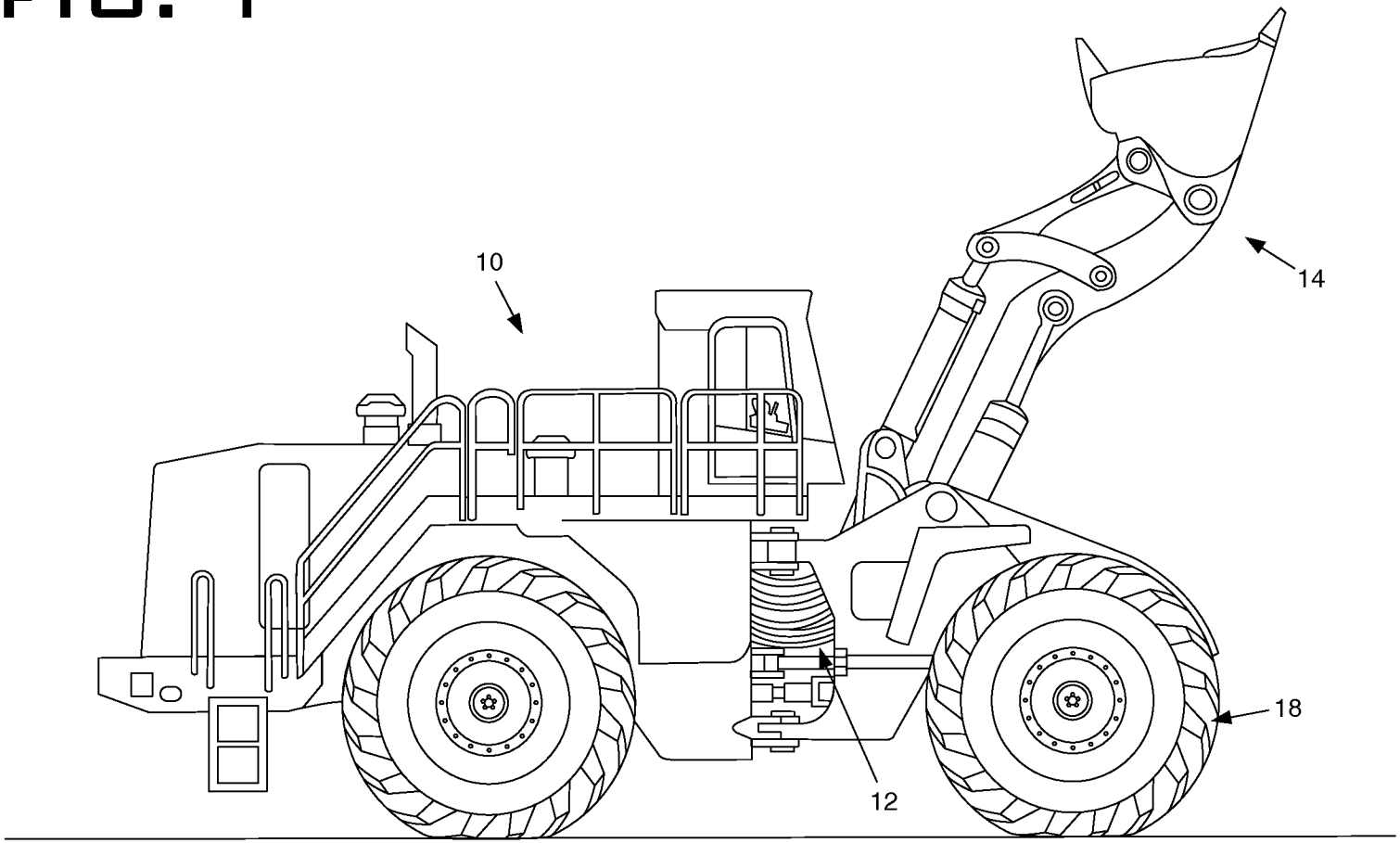
FIG. 1 is a side-view diagrammatic illustration of an exemplary machine.
Figure 2:
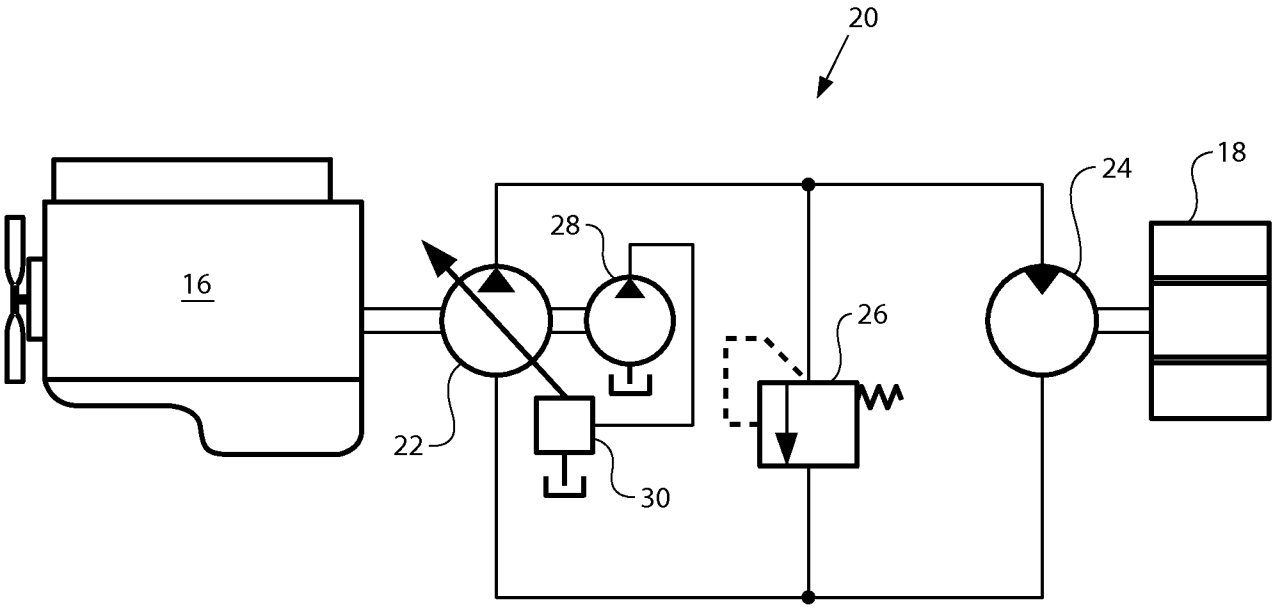
FIG. 2 is a schematic illustration of an exemplary transmission.

FIG. 1 illustrates an exemplary machine 10. Machine 10 may be a fixed or mobile machine that performs operations associated with an industry such as mining, construction, farming, or any other industry known in the art. For example, machine 10 may be an earth moving machine such as a dozer, a loader, a backhoe, an excavator, a motor grader, a dump truck, or any other earth moving machine. Machine 10 may also embody a generator set, a pump, a marine vessel, or any other suitable machine. Referring to FIGS. 1 and 2, machine 10 may include a frame 12, an implement 14, traction devices 18 such as wheels or tracks, and a transmission 20 (FIG. 2) to transfer power from an engine 16 (FIG. 2) to the traction devices 18.

As illustrated in FIG. 2, the transmission 20 may be a hydrostatic transmission and may include a source of pressurized fluid, for example a primary pump 22 driven by the engine 16, a motor 24 and a bypass relief valve 26. In practice, transmission may be a continuously variable transmission (CVT), parallel path variable transmission (PPV), or other transmission known in the art. According to the present disclosure, the primary pump 22 may be a variable displacement pump such as a variable displacement axial piston pump, the displacement of which may be varied by changing the angle of inclination of a swashplate (not shown). The motor 24 may be a fixed displacement hydraulic motor. However, the motor 24 may alternatively be a variable displacement motor. The transmission 20 may further include another source of pressurized fluid, for example a charge pump 28 providing pressurized fluid to swashplate control hardware 30, which is illustrated in greater detail in FIG. 3.

Figure 3:
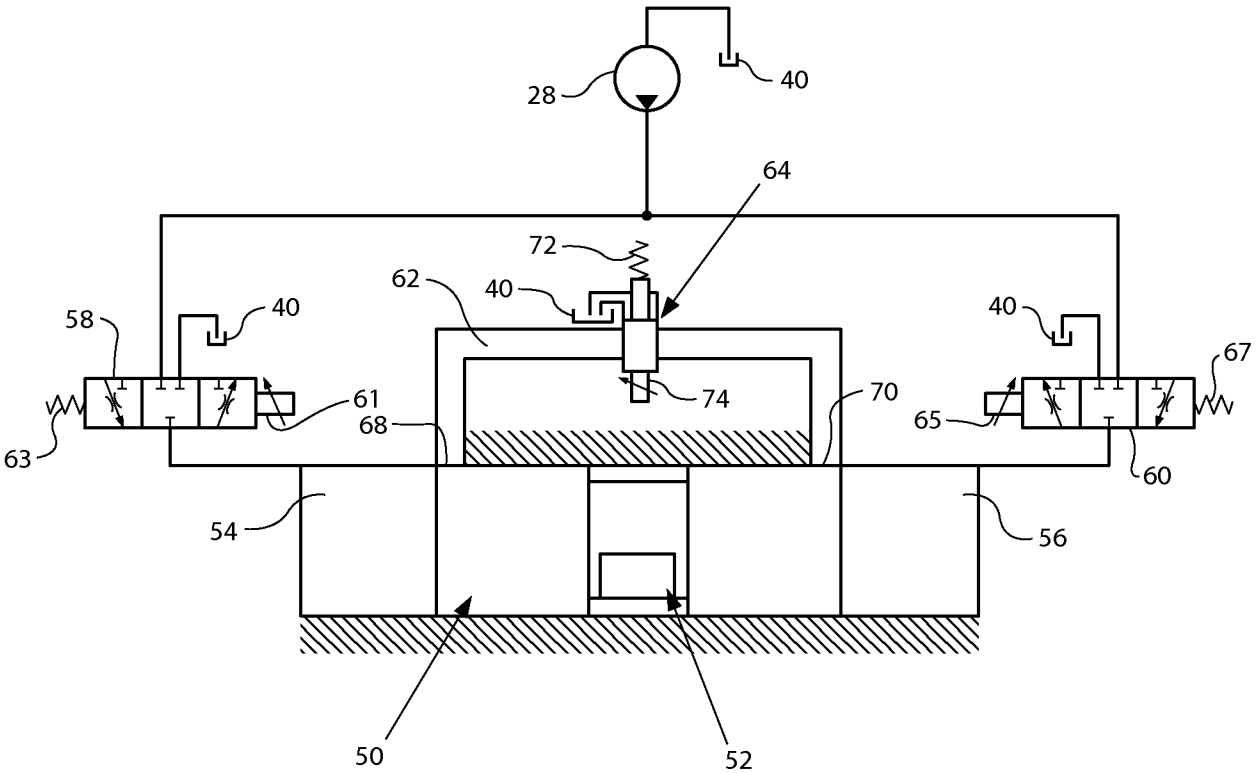
FIG. 3 is a schematic illustration of exemplary pump control hardware in a first condition.

FIG. 3 illustrates a portion of the control hardware 30. Control hardware 30 includes an actuator 50 having a connection portion 52 configured to accept a swashplate control arm (not shown), such that translation of the actuator 50 effects a change in an angular orientation of the primary pump's 22 swashplate (not shown). The position of actuator 50 is controlled by a first pressure chamber 54 and a second pressure chamber 56. First pressure chamber 54 is selectively placed in communication with charge pump 28 and tank 40 by a first three-position three-way control valve 58, which is actuated by an electrical device, such as a solenoid 61, acting against a mechanical device, such as a spring 63. Similarly, second pressure chamber 56 is selectively placed in communication with charge pump 28 and tank 40 by a second three-position three-way control valve 60, which is actuated by an electrical device, such as a solenoid 65, acting against a mechanical device, such as a spring 67.

With respect to FIG. 3, movement of actuator 50 to the right is effected by de-energizing the solenoid 61 associated with the first control valve 58 to place the first pressure chamber 54 in communication with charge pump 28 and energizing the solenoid 65 associated with the second control valve 60 to place the second pressure chamber 56 in communication with tank 40. Similarly, movement of actuator 50 to the left is effected by energizing the solenoid 61 associated with the first control valve 58 to place the first pressure chamber 54 in communication with tank 40 and de-energizing the solenoid 65 associated with the second control valve 60 to place the second pressure chamber 56 in communication with charge pump 28.

A fluid passageway 62 is provided between the first control chamber 54 and the second control chamber 56. The passageway 62 has a first orifice 68 connecting the passageway 62 with the first pressure chamber 54 and a second orifice 70 connecting the passageway 62 with the second pressure chamber 56. In the embodiment illustrated in FIG. 3, the first and second orifices 68, 70 are blocked by the actuator 50 when the actuator 50 is in a neutral position, as illustrated. The neutral position of the actuator may be characterized by the actuator being substantially centered with respect to the first and second orifices 68, 70. It is contemplated that a neutral and near-neutral position of the actuator will correspond to a substantially neutral orientation of the swashplate, and a null or minimal displacement of the primary pump 22.

In the embodiment illustrated in FIG. 3 a relatively small movement of the actuator 50 to the right will open the first orifice 68 to the first pressure chamber 54, and a relatively small movement of the actuator 50 to the left will open the first orifice 70 to the second pressure chamber 54. A drain valve 64 is disposed within the passageway 62 having an open and a closed position. A mechanical device, such as a spring 72, biases drain valve 64 toward the open position and an electrical device, such as a solenoid 74, biases the drain valve 64 toward the closed position. When drain valve 64 is in the open position, fluid is capable of passing through passageway 62 to tank 40. When drain valve 64 is in the closed position, fluid is restricted from flowing through passageway 62 to tank 40, and from flowing to either of the first or second orifices 68, 70 from the other of the first or second orifices 68, 70.

INDUSTRIAL APPLICABILITY

During normal operation of the primary pump 22, solenoid 74 is energized, moving drain valve 64 to the closed position. In this manner pressurized fluid may be provided to and from the first and second chambers 54, 56 to move actuator 50 and change the angle of the swashplate and, thus the displacement of the primary pump 22.

Figure 4:
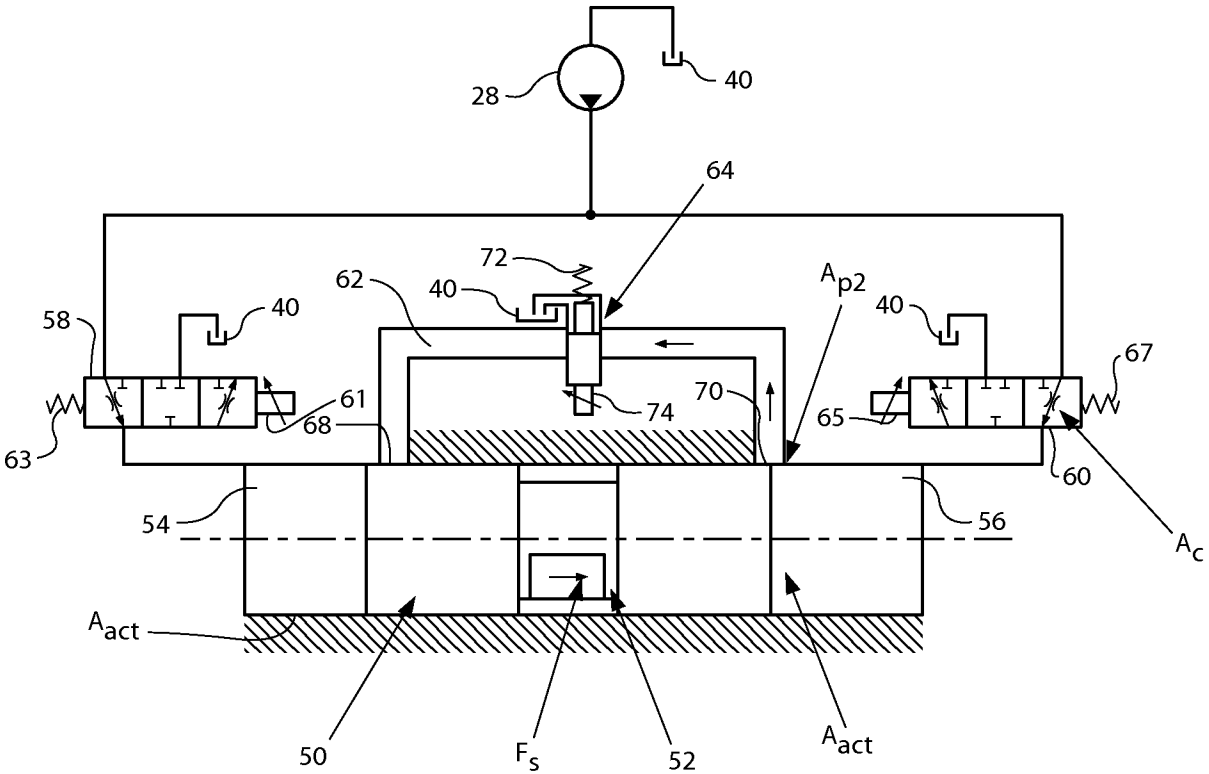
FIG. 4 is a schematic illustration of the exemplary pump control hardware of FIG. 3 in a second condition.

Upon loss of electrical power, the control hardware 30 may assume the configuration illustrated in FIG. 4. In this condition the first and second control valves 58, 60 are actuated by their respective springs to a flow passing position, such that both first and second pressure chambers 54, 56 are in communication with charge pump 28. Furthermore, drain valve 64 is also biased by spring 72 to the open position. With further reference to FIG. 4 actuator 50 is left of a neutral position, thereby communicating second pressure chamber 56 with tank 40 by way of passageway 62 through an exposed area, $A_{p2}$, of the second orifice 70. The flow of fluid from second pressure chamber 56 to tank 40 will result in the second pressure chamber 56 being at a lower pressure than the first pressure chamber 54. This pressure imbalance will bias the actuator 50 towards a neutral position. However, due to forces acting on the swashplate, the swashplate arm may exert a force, $F_s$, on the actuator 50 as well. Thus, the actuator 50 will move to an equilibrium position, which will generally be close to a neutral position. Neglecting the effects of friction, this equilibrium area of $A_{p1}$ can be approximated by Eq. 1, in which $A_c$ is the metering area of the second control valve 60, $A_{act}$ is surface area of the right side of the actuator 50 being acted upon by the pressure in the second pressure chamber 56, and $P_{charge}$ is the pressure of the fluid being discharged from the charge pump 28.

$$A_{p2}^2 = \frac{A_c^2}{\frac{A_{act}P_{charge}}{F_s} - 1} \qquad \text{Eq. 1}$$

Accordingly, by using Eq. 1, the steady state position of the actuator 50 can be approximated by using a map comparing actuator 50 position to the exposed area, $A_{p2}$, of the second orifice 70.

Figure 5:
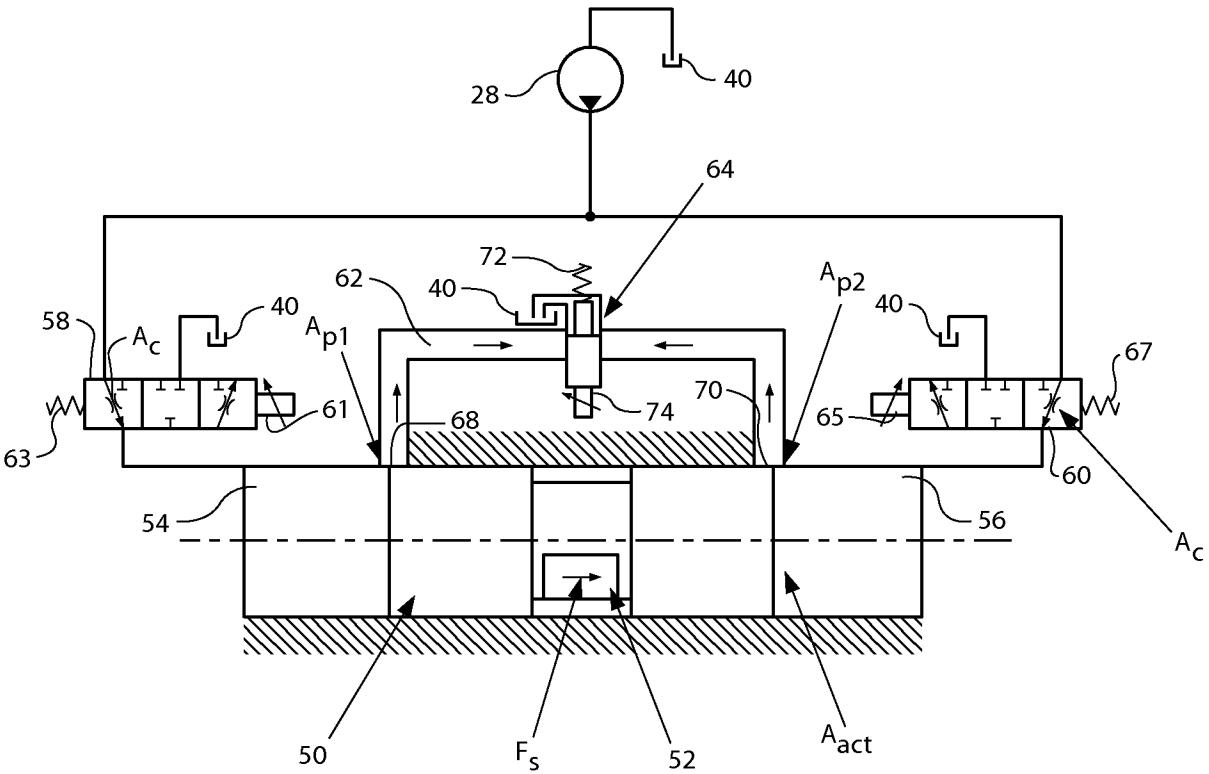
FIG. 5 is a schematic illustration of another embodiment exemplary pump control hardware.

In another embodiment illustrated in FIG. 5, actuator 50 is sized such that it is underlapping in a neutral position, which is to say that in a neutral position both the first and second orifices 68, 70 are in communication with their respective pressure chambers 54, 56. In such an underlapping condition, an equilibrium position in terms of $A_{p1}$ and $A_{p2}$ can be approximated by Eq. 2, where $A_{p1}$ is the exposed area of the first orifice 68.

$$A_{p1}^2 - A_{p2}^2 = \frac{(A_c^2 + A_{p1}^2)(A_c^2 + A_{p2}^2)}{A_c^2 A_{act} P_{charge}} F_s \qquad \text{Eq. 2}$$

Accordingly, in an underlapping condition, by using Eq. 2, the steady state position of the actuator 50 can be approximated by using map comparing actuator 50 position to the difference of the square of the exposed areas, i.e. $A_{p1}^2 - A_{p2}^2$.

It will be apparent to those skilled in the art that various modifications and variations can be made to the disclosed hydraulic system. Other embodiments will be apparent to those skilled in the art from consideration of the specification and practice of the disclosed hydraulic system. In particular, it will be apparent to those skilled in the art that the control system describe herein for use on a variable displacement pump, may also be utilized on a variable displacement motor. It is intended that the specification and examples be considered as exemplary only, with a true scope being indicated by the following claims and their equivalents.

What is claimed is:

1. A hydraulic system comprising:

a source of pressurized fluid;

a tank;

an actuator disposed between a first pressure chamber and a second pressure chamber;

a fluid passageway having a first orifice in selective communication with the first pressure chamber and a second orifice in selective communication with the second pressure chamber; and a drain valve disposed in the fluid passageway having an open position and a closed position;

wherein fluid is passable from at least one of the first orifice and the second orifice to the tank when the drain valve is in the open position; and wherein fluid is restricted from passing from both the first orifice and the second orifice to the tank when the drain valve is in the closed position.

2. The hydraulic system of claim 1, wherein the drain valve is biased toward the open position by a first mechanical device and biased toward the closed position by a first electrical device.

3. The hydraulic system of claim 2 further including a first control valve having a first position and a second position, wherein the first position of the first control valve communicates the first pressure chamber with the source and the second position of the first control valve communicates the first pressure chamber with the tank.

4. The hydraulic system of claim 3, wherein the first control valve is biased toward the first position by a second mechanical device.

5. The hydraulic system of claim 4, wherein the first control valve is biased toward the second position by a second electrical device.

6. The hydraulic system of claim 5 further comprising a second control valve having a first position and a second position, wherein the first position of the second control valve communicates the second pressure chamber with the source and the second position of the second control valve communicates the second pressure chamber with the tank.

7. The hydraulic system of claim 6, wherein the second control valve is biased toward the first position by a third mechanical device.

8. The hydraulic system of claim 7, wherein the second control valve is biased toward the second position by a third electrical device.

9. The hydraulic system of claim 8 further comprising a swashplate having an angle of inclination, wherein movement of the actuator effects a change in the angle of inclination.

10. The hydraulic system of claim 1, wherein fluid is passable from both the first orifice and the second orifice to the tank when the drain valve is in the open position.

11. The hydraulic system of claim 10 wherein fluid is simultaneously passable from both the first orifice and the second orifice to the tank when the drain valve is in the open position.

12. A system for controlling a displacement of a variable displacement hydraulic device having a swashplate comprising:

a source of pressurized fluid;

a tank;

an actuator disposed between a first pressure chamber and a second pressure chamber, the actuator being in operative communication with the swashplate;

a fluid passageway having a first orifice in selective communication with the first pressure chamber and a second orifice in selective communication with the second pressure chamber; and a drain valve disposed in the fluid passageway having an open position and a closed position;

wherein fluid is passable from at least one of the first orifice and the second orifice to the tank when the valve is in the open position; and wherein fluid is restricted from passing from both the first orifice and the second orifice to the tank when the valve is in the closed position.

13. The system of claim 12, wherein fluid is passable from both the first orifice and the second orifice to the tank when the valve is in the open position.

14. The hydraulic system of claim 13, wherein fluid is simultaneously passable from both the first orifice and the second orifice to the tank when the valve is in the open position.

15. The system of claim 12, wherein the drain valve is biased toward the open position by a first spring and biased toward the closed position by a first solenoid.

16. The system of claim 15 further including a first control valve having a first position and a second position, wherein the first position of the first control valve communicates the first pressure chamber with the source and the second position of the first control valve communicates the first pressure chamber with the tank, and wherein the first control valve is biased toward the first position by a second spring and the first control valve is biased toward the second position by a second solenoid.

17. The system of claim 16 further including a second control valve having a first position and a second position, wherein the first position of the second control valve communicates the second pressure chamber with the source and the second position of the second control valve communicates the second pressure chamber with the tank, and wherein the second control valve is biased toward the first position by a third spring and the second control valve is biased toward the second position by a third solenoid.

18. A method for controlling an inclination of a swashplate comprising the steps:

changing the inclination of a swashplate by energizing a first electrical device associated with a first control valve, de-energizing a second electrical device associated with a second control valve, and energizing a third electrical device associated with a drain valve; and returning the swashplate to a neutral position or a near-neutral position by de-energizing the first electrical device, de-energizing the second electrical device, and de-energizing the third electrical device.

19. The method of claim 18, wherein the first, second and third electrical devices are solenoids, and the first, second and third mechanical devices are springs.

20. The method of claim 18, wherein the first control valve is associated with a first pressure chamber; the second control valve is associated with a second pressure chamber; and the drain valve is disposed between a passageway and a tank, the passageway having a first orifice in selective communication with the first pressure chamber and a second orifice in selective communication with the second pressure chamber.

* * * * *